US008469226B2

(12) United States Patent
Davies et al.

(10) Patent No.: US 8,469,226 B2
(45) **Date of Patent: *Jun. 25, 2013**

(54) DRINK CONTAINERS

(75) Inventors: Jeff Davies, Windsor, CA (US); Derek Gavin Sullivan, Oakland, CA (US)

(73) Assignee: CamelBak Products, LLC, Petaluma, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/620,078

(22) Filed: Sep. 14, 2012

(65) Prior Publication Data

US 2013/0008902 A1 Jan. 10, 2013

Related U.S. Application Data

(63) Continuation of application No. 13/479,962, filed on May 24, 2012, which is a continuation of application No. 12/357,114, filed on Jan. 21, 2009, now Pat. No. 8,191,727.

(51) Int. Cl.
*A47G 19/22* (2006.01)

(52) U.S. Cl.
USPC ..... 220/707; 220/709; 215/387

(58) Field of Classification Search
USPC ..... 220/252, 705, 707–709; 215/387–389
See application file for complete search history.

(56) References Cited

U.S. PATENT DOCUMENTS

| | | | |
|---|---|---|---|
| 3,181,743 | A | 5/1965 | Libit et al. |
| 3,294,293 | A | 12/1966 | Johns |
| 3,907,179 | A | 9/1975 | Pehr et al. |
| 4,485,963 | A | 12/1984 | Panicci |
| 4,860,934 | A | 8/1989 | Komischke |
| 5,203,468 | A | 4/1993 | Hsu |
| 5,242,079 | A | 9/1993 | Stephens et al. |
| 5,273,172 | A | 12/1993 | Rossbach et al. |
| 5,332,131 | A | 7/1994 | Pehr |
| 5,337,918 | A | 8/1994 | Wang |
| 5,392,968 | A | 2/1995 | Dark |
| 5,465,866 | A | 11/1995 | Belcastro |
| 5,518,142 | A | 5/1996 | Lin |

(Continued)

FOREIGN PATENT DOCUMENTS

| | | |
|---|---|---|
| WO | WO 98/46106 | 10/1998 |
| WO | WO 00/49922 | 8/2000 |

OTHER PUBLICATIONS

Description and photographs of Thermos® Foogo™ Straw Bottle purchased Dec. 2008.

*Primary Examiner* — J. Gregory Pickett
*Assistant Examiner* — Robert Poon
(74) *Attorney, Agent, or Firm* — Dascenzo Intellectual Property Law, P.C.

(57) ABSTRACT

Drink containers with mouthpiece assemblies having a dispensing configuration and a stowed configuration. A mouthpiece assembly defines a liquid passage through which drink liquid may be dispensed when the mouthpiece assembly is in the dispensing configuration and includes means for selectively restricting the flow of drink liquid through the liquid passage when the mouthpiece assembly is in the stowed configuration. In some examples, the means for selectively restricting the flow of drink liquid include a tube that at least partially defines the liquid passage and which includes a crimping region. The crimping region may be constructed of a resiliently and reversibly deformable material that is adapted to restrict the flow of drink liquid through the liquid passage when the mouthpiece assembly is in the stowed configuration. In some embodiments, the mouthpiece assembly includes a means for automatically releasing the mouthpiece assembly from its stowed configuration to a dispensing configuration.

33 Claims, 4 Drawing Sheets

U.S. PATENT DOCUMENTS 5,520,304 A 5/1996 Lin
5,582,320 A 12/1996 Lin
5,873,478 A 2/1999 Sullivan et al.
5,884,793 A 3/1999 Wang
5,897,013 A 4/1999 Manganiello
6,050,445 A 4/2000 Manganiello
6,059,154 A 5/2000 Bigotte et al.
6,070,767 A 6/2000 Gardner et al.
6,116,458 A 9/2000 Dark
6,276,560 B1 8/2001 Belcastro
6,279,773 B1 8/2001 Kiyota
6,390,341 B1 5/2002 Ohmi et al.
6,422,415 B1 7/2002 Manganiello
6,607,092 B2 8/2003 Manganiello et al.
6,609,624 B2 8/2003 Goto et al.
6,675,998 B2 1/2004 Forsman et al.
6,745,949 B2 6/2004 Lee
6,915,961 B2 7/2005 Renz et al.
7,147,126 B2 12/2006 Samson et al.
7,201,284 B2 4/2007 Clark et al.
D547,606 S 7/2007 Forsman
D547,607 S 7/2007 Forsman
7,255,241 B2 8/2007 Yoneoka et al.
7,533,783 B2 5/2009 Choi et al.
2003/0085232 A1 5/2003 Leinenweber
2003/0218015 A1 11/2003 Randolph et al.
2004/0069783 A1 4/2004 Chen
2004/0159820 A1 8/2004 Yang
2005/0029271 A1 2/2005 McDonough
2005/0056610 A1 3/2005 Randolph et al.
2005/0133519 A1 6/2005 McDonough
2005/0205587 A1 9/2005 Sampson et al.
2005/0218242 A1 10/2005 Renz et al.
2006/0226110 A1 10/2006 Choi et al.
2007/0039959 A1 2/2007 Choi et al.
2008/0237233 A1 10/2008 Choi et al.
2010/0170902 A1 7/2010 Britto et al.
2010/0181329 A1 7/2010 Davies et al.

DRINK CONTAINERS

RELATED APPLICATIONS

The present application is a continuation patent application that claims priority under 35 U.S.C. §120 to U.S. patent application Ser. No. 13/479,962, which is entitled "Drink Containers," was filed on May 24, 2012, and which claims priority to U.S. patent application Ser. No. 12/357,114, which is entitled "Drink Containers," was filed on Jan. 21, 2009, and issued as U.S. Pat. No. 8,191,727 on Jun. 5, 2012. The complete disclosures of the above-identified applications are hereby incorporated by reference.

FIELD OF THE DISCLOSURE

The present disclosure relates generally to drink containers, and more particularly to drink containers with mouthpiece assemblies that have a dispensing configuration and a stowed configuration.

BACKGROUND OF THE DISCLOSURE

For some time, people have recognized the need to stay hydrated. Conventionally, many individuals carry drink bottles that contain water or other potable beverages. These bottles are typically formed from plastic or metal and include a cap. Some conventional drink bottles include a threaded or other neck from which a user drinks liquid contained in the drink bottle after removal of the cap. Some conventional drink bottles include a spout, or nozzle, from which the drink liquid may be drawn from the drink bottle without removing the cap of the drink bottle. Conventional spouts typically include a flexible straw or a rigid spout having an outlet through which drink liquid may flow.

SUMMARY OF THE DISCLOSURE

Drink containers according to the present disclosure include a liquid container and a cap assembly with a mouthpiece assembly that is adapted to be selectively configured between a dispensing configuration, in which drink liquid may be selectively dispensed from the liquid container, and a stowed configuration, in which drink liquid is restricted from being dispensed from the liquid container. In some examples, the mouthpiece assembly includes a tube portion, at least a portion of which defines a crimping region that is constructed of a resiliently deformable material and that is adapted to restrict the flow of drink liquid therethrough when the mouthpiece assembly is in the stowed configuration. Some examples of drink containers according to the present disclosure further include a user-release mechanism that is adapted to automatically, upon user actuation, release the mouthpiece assembly from the stowed configuration to the dispensing configuration. In some examples, the mouthpiece assembly is biased toward the dispensing configuration and thus moves automatically under its bias upon release by the user-release mechanism.

DETAILED DESCRIPTION AND BEST MODE OF THE DISCLOSURE

Figure 1:
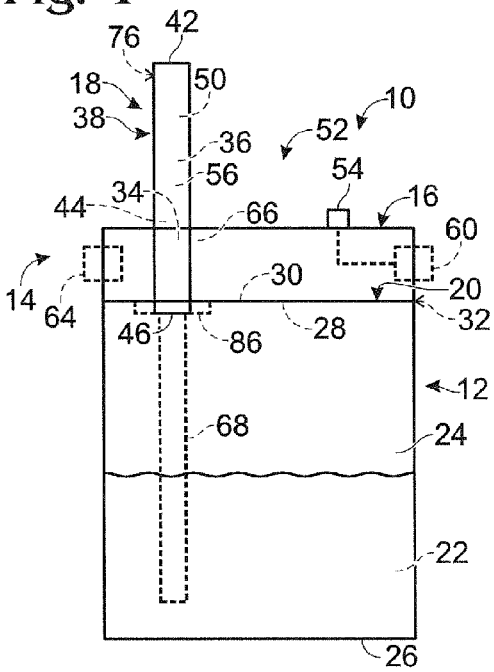
FIG. 1 is a schematic illustration of a drink container according to the present disclosure with the drink container's mouthpiece assembly illustrated in a dispensing configuration.

Drink containers according to the present disclosure are schematically illustrated in FIGS. 1-4 and are indicated generally at 10. Drink containers 10 according to the present disclosure are designed to receive and selectively dispense to a user a volume of potable drink liquid. Illustrative, non-exclusive examples of drink liquids that may be used in drink containers 10 according to the present disclosure include such potable liquids as water, juice, sports drinks, milk, soft drinks, and the like. Drink containers 10 include a liquid container 12 and a cap assembly 14 having a unique mouthpiece assembly.

Liquid containers 12 according to the present disclosure are adapted to receive and hold or otherwise contain up to a predetermined volume of drink liquid 22 for selective consumption by a user. Liquid containers 12 may include an open neck 20, through which drink liquid 22 may be selectively poured, or otherwise dispensed, into an internal compartment 24 of the liquid container, and from which the drink liquid may be selectively dispensed from the internal compartment to a user. It is within the scope of the present disclosure that neck 20 may (but is not required in all embodiments to) define the only opening through which drink liquid may be added to or removed from the liquid container. As discussed in more detail herein, when cap assembly 14 is operatively coupled to the liquid container, this selective dispensing of the drink liquid may be responsive to whether or not a mouthpiece assembly of the cap assembly has been configured to a dispensing configuration, and in some embodiments, whether a mouthpiece portion of the mouthpiece assembly has been configured to an open configuration. As used herein, "selective" and "selectively," when modifying an action, movement, configuration, or other activity of one or more components or characteristics of a drink container according to the present disclosure, means that the specified action, movement, configuration, or other activity is a direct or indirect result of user manipulation of an aspect of, or one or more components of, the drink container.

Liquid containers 12 may have any suitable shape and be formed from any suitable material or combination of materials to hold up to a predetermined volume of drink liquid. Illustrative, non-exclusive examples of suitable sizes, or capacities, of liquid containers 12 (i.e., volume of drink liquid 22 able to be received into a liquid container at one time) include 4 oz., 6 oz., 8 oz., 10 oz., 12 oz., 16 oz., 20 oz., 24 oz., 32 oz., 36 oz., 4-11 oz., 12-19 oz., 19-25 oz., 12-36 oz., 25-36 oz., and 10-70 oz. (with these illustrative examples referring to liquid (fluid) ounces of drink liquid that may be received at one time into an empty liquid container). It is within the scope of the present disclosure that liquid containers having different sizes, including sizes that are smaller than, larger than, or within the illustrative sizes and/or ranges presented above, may be used without departing from the scope of the present disclosure.

An illustrative, non-exclusive example of a material that may be used to construct liquid containers 12 according to the present disclosure includes the TRITAN™ copolyester polymer developed by Eastman Chemical Company. Other illustrative, non-exclusive examples of materials that may be suitable for construction of liquid containers according to the present disclosure include polycarbonate and metal, such as aluminum. Further illustrative, non-exclusive examples are disclosed in U.S. Patent Application Publication No. 2006/0226110, the entire contents of which are hereby incorporated by reference.

Liquid containers 12 may be (but are not required to be) rigid or at least semi-rigid and may include a bottom surface 26 such that a liquid container may be generally self-supporting, or free-standing. In such embodiments, drink containers 10 may be referred to as drink bottles. In some illustrative, non-exclusive embodiments, a liquid container 12 according to the present disclosure may be constructed of polyethylene or other material that permits the liquid container to be reversibly collapsed during use. Such an illustrative, non-exclusive example may permit opposing portions of the liquid container to be urged toward or even into contact with each other to reduce the volume of the liquid container and thereby aid in the dispensing of drink liquid 22 therefrom. In such an embodiment, the liquid container may be configured to return automatically to its prior configuration upon reduction of the pressure that was applied to urge the sides of the liquid container toward each other.

Cap assemblies 14 according to the present disclosure may be adapted to be removably coupled to a liquid container 12 to cover, or otherwise enclose, the neck 20 thereof. When so coupled to a liquid container, a cap assembly 14 restricts drink liquid within the liquid container's internal compartment 24 from being dispensed from the drink container other than through a liquid passage 36 defined by the cap assembly. When this liquid passage is obstructed or otherwise closed or sealed, the cap assembly prevents drink liquid from being dispensed from the liquid container. Accordingly, any drink liquid in the internal compartment of the liquid container is prevented from being dispensed to a user or otherwise removed from the liquid container until either the cap assembly is uncoupled from the liquid container or until the liquid passage is configured by a user to a configuration in which drink liquid may flow therethrough.

Cap assemblies 14 according to the present disclosure include a base 16 and a mouthpiece assembly 18. Furthermore, cap assemblies 14 define a liquid passage 36, through which drink liquid 22 may be selectively drawn, or otherwise dispensed, by a user from the internal compartment of an attached liquid container 12.

Although not required in all embodiments, cap assembly 14 is typically removably coupled to liquid container 12, such as to neck 20 thereof, to permit selective and non-destructive removal and replacement (i.e., uncoupling and recoupling) of the cap assembly relative to the liquid container. For example, cap assembly 14 may be uncoupled from the liquid container to permit the liquid container to receive a volume of drink liquid, after which the cap assembly may be recoupled to the liquid container. Accordingly, drink containers 10 according to the present disclosure may include a coupling assembly 32, with the liquid container 12 including coupling structure 30 and the cap assembly 14 including coupling structure 28, which is adapted to selectively mate with coupling structure 30. In such an embodiment, neck 20 of the liquid container may include coupling structure 30, and base 16 of cap assembly 14 may include coupling structure 28. Coupling assembly 32 may provide a liquid-tight connection between the cap assembly and the liquid container. When such a connection is established between the cap assembly and the liquid container, the cap assembly may restrict liquid from being dispensed from the drink container other than through a through-passage 34 and/or a liquid passage 36 defined by the cap assembly. Illustrative, non-exclusive examples of coupling assembly 32 that may be incorporated into drink containers according to the present disclosure include (but are not limited to) threads, snap-fit arrangements, friction-fit arrangements, clasp arrangements, etc.

Base 16 further includes a through-passage 34 through which the mouthpiece assembly 18 at least partially, if not completely, extends to enable the mouthpiece assembly to receive drink liquid from the internal compartment 24 of liquid container 12 and selectively permit the drink liquid to flow through the liquid passage defined by the mouthpiece assembly for dispensing to a user.

Mouthpiece assemblies 18 according to the present disclosure define the liquid passage 36, through which drink liquid from the liquid container may be selectively drawn by a user. Mouthpiece assemblies 18 define an inlet 46, which is in fluid communication with the internal compartment of the liquid container when the cap assembly is coupled thereto, and an outlet 42, through which drink liquid from the liquid container may be selectively dispensed through the liquid passage to a user. Mouthpiece assemblies 18 may be selectively configured between a dispensing configuration 38, in which the mouthpiece assembly permits drink liquid to flow from the internal compartment of the liquid container (such as illustrated in FIGS. 1 and 3) at least into the liquid passage of the mouthpiece assembly, and a stowed configuration 40, in which the mouthpiece assembly restricts the flow of drink liquid through the liquid passage to outlet 42 (such as illustrated in FIGS. 2 and 4).

When operatively positioned to extend through the through-passage of the base, the mouthpiece assembly may be restricted from being removed therefrom, at least without first uncoupling the cap assembly from the drink container to permit access to the underside of the cap assembly. Mouthpiece assembly 18 may therefore be described as being anchored, or at least selectively anchored, to base 16 and/or to through-passage 34 of base 16. Additionally or alternatively, mouthpiece assembly 18 may in some embodiments be described as being configured to be non-destructively removed from through-passage 34 from the underside of the cap assembly but not from the top side of the cap assembly. As an illustrative, non-exclusive example, the mouthpiece assembly and the through-passage may have a friction-fit arrangement. As another illustrative, non-exclusive example, the mouthpiece assembly may include an anchor, or anchor portion, 86 that is sized so as not to fit through the through-passage of the base, such as by being too large to fit therethrough. Other configurations are also within the scope of the present disclosure.

Figure 2:
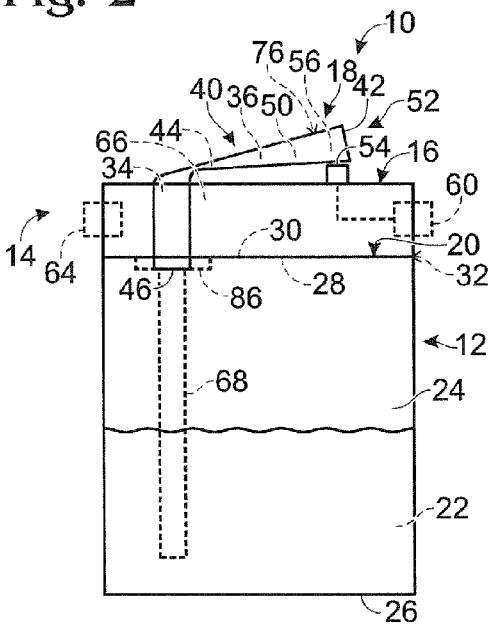
FIG. 2 is a schematic illustration of the drink container of FIG. 1 with the mouthpiece assembly illustrated in a stowed configuration.
Figure 3:
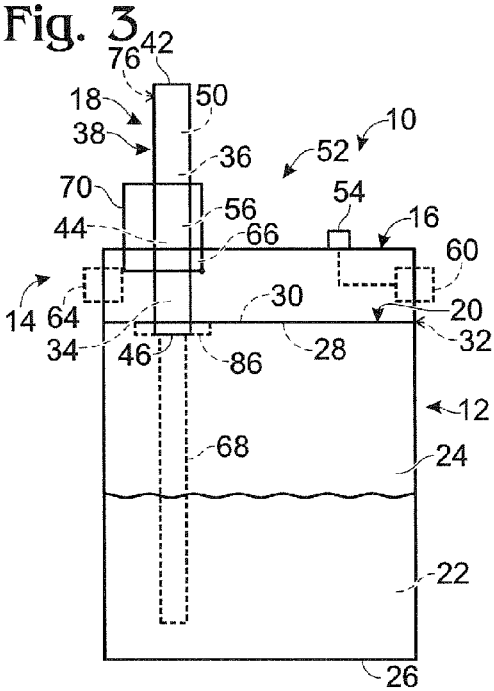
FIG. 3 is another schematic illustration of a drink container according to the present disclosure with the drink container's mouthpiece assembly illustrated in a dispensing configuration.
Figure 4:
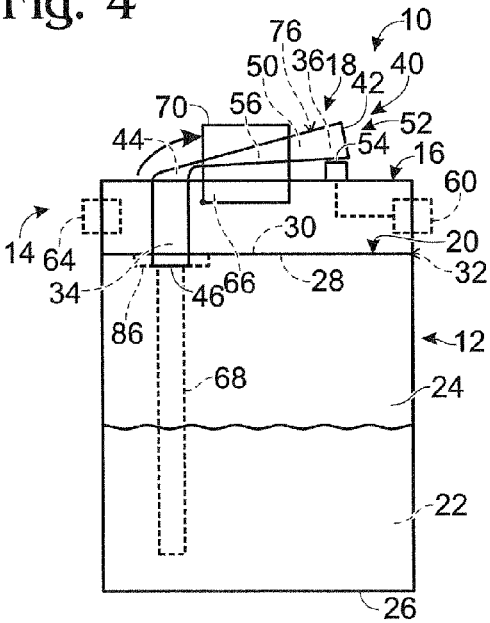
FIG. 4 is a schematic illustration of the drink container of FIG. 3 with the mouthpiece assembly illustrated in a stowed configuration.

As illustrated in FIGS. 1 and 3, at least a portion of the mouthpiece assembly 18 (such as a mouthpiece portion 76 thereof) may project generally away from the base of the cap assembly when the mouthpiece assembly is in the dispensing configuration 38, and as illustrated in FIGS. 2 and 4, at least a portion of the mouthpiece assembly (such as a mouthpiece portion 76 thereof) may extend generally against, adjacent to, or otherwise along the base of the cap assembly when the mouthpiece assembly is in the stowed configuration 40. In the schematically illustrated examples of FIGS. 1-4, the mouthpiece assembly, or at least a portion thereof, is adapted to be pivoted by a user between the dispensing and stowed configurations. Other configurations are also within the scope of the present disclosure. For example, in some embodiments, a mouthpiece assembly may be configured to be selectively positioned within a range of dispensing positions.

Mouthpiece assemblies 18 include at least a crimping region 44, which permits drink liquid to flow through liquid passage 36 when the mouthpiece assembly is in the dispensing configuration, and which prevents, or at least restricts, drink liquid from flowing through liquid passage 36 when the mouthpiece assembly is in the stowed configuration. For example, in some mouthpiece assemblies 18 according to the present disclosure, the crimping region may be constructed of a resiliently deformable material such that when the mouthpiece assembly, or at least a portion thereof, is pivoted, or otherwise folded, the crimping region of the mouthpiece assembly becomes crimped, or folded on itself, such that opposing walls of the crimping region come into contact with each other and effectively, or at least partially, seal the liquid passage within the crimping region of the mouthpiece assembly. When in such a crimped configuration, drink fluid is restricted or even prevented from flowing through the liquid passage from its inlet to its outlet due to the obstruction formed by the crimping region.

Mouthpiece assemblies 18 according to the present disclosure are biased toward the dispensing configuration and therefore may be described as having a biasing mechanism 50. The bias of a mouthpiece assembly according to the present disclosure may be provided by the internal bias created by the material from which at least a portion of the mouthpiece assembly is constructed. For example, at least a portion of a mouthpiece assembly, such as crimping region 44, may be constructed of a resiliently deformable material. An illustrative, non-exclusive example of a suitable resiliently deformable material includes (but is not limited to) silicone. Additionally or alternatively, a biasing mechanism 50 may include at least one spring. Other configurations are also within the scope of the present disclosure.

Cap assemblies 14 according to the present disclosure further include a mouthpiece securing mechanism 52 that is adapted to selectively retain the mouthpiece assembly in stowed configuration 40. Accordingly, a user of a drink container 10 may selectively configure, or move, the mouthpiece assembly from the dispensing configuration into the stowed configuration to prevent, or at least restrict, drink liquid from being dispensed from the drink container, for example, when not using the drink container, when transporting the drink container, or in other situations in which a user may wish to prevent drink liquid from being dispensed. When a user wishes to drink from the drink container and thus dispense drink liquid therefrom, the user may reconfigure the mouthpiece assembly from stowed configuration 40 to dispensing configuration 38. In some embodiments, the mouthpiece assembly may be biased to its dispensing configuration, such as by including a suitable biasing mechanism or structure. In such an embodiment, the mouthpiece assembly may be configured to move automatically via, or under, its bias to the dispensing configuration upon release from its stowed configuration.

Mouthpiece securing mechanism 52 includes a first catch structure 54 and a second catch structure 56. First catch structure 54 may be coupled to, integral to, formed as part of, or otherwise disposed on or within the base or other portion of the cap assembly, and second catch structure 56 may be coupled to, integral to, formed as part of, or otherwise disposed on or within the mouthpiece assembly. Accordingly, first and second catch structures 54, 56 may be adapted to be selectively engaged, or mated, with each other to retain the mouthpiece assembly in the stowed configuration, as schematically illustrated in FIGS. 2 and 4.

To permit the reconfiguring of the mouthpiece assembly from the stowed configuration to the dispensing configuration, cap assemblies 14 according to the present disclosure may (but are not required to) include a user release mechanism 60 that is adapted to automatically disengage the first and second catch structures from each other upon actuation of the user release mechanism and thereby release the mouthpiece assembly to move via its bias from the stowed configuration to the dispensing configuration. As schematically illustrated in FIGS. 1-4, the optional user release mechanism may therefore be tied to, or otherwise have a mechanical relationship with, the second catch structure of the base of the cap assembly. Additionally or alternatively, a user release mechanism according to the present disclosure may be tied to, or otherwise have a mechanical relationship with, the first catch structure of the mouthpiece assembly. Although schematically illustrated as part of the base of the cap assembly, a user release mechanism according to the present disclosure may also be part of, integral to, or otherwise disposed on, the mouthpiece assembly or the liquid container. Other configurations are also within the scope of the present disclosure.

Cap assemblies 14 according to the present disclosure may further include (but are not required to include) a vent, or air return assembly, 64 that is adapted to permit air from external the drink container to enter the internal compartment 24 of the liquid container 12 without having to pass through the liquid passage 36 of the mouthpiece assembly 18. Vent 64 is illustrated as being implemented on the base 16 of the cap assembly 14, with the particular position and/or orientation of the vent on the base not being critical to a particular embodiment. Vent 64, when present, may include no valve or may include a valve, such as a one-way and/or a pressure-actuated valve. It is within the scope of the present disclosure that the vent, when present, may be implemented as part of the mouthpiece assembly or as part of or on the liquid container. Other configurations are also within the scope of the present disclosure. Illustrative, non-exclusive examples of vents that may be utilized with or incorporated into drink containers according to the present disclosure are disclosed in U.S. Patent Application Publication No. 2006/0226110, incorporated herein.

Cap assemblies 14 according to the present disclosure may include (but are not required to include) a crimping portion 66 that is adapted to engage and crimp the crimping region 44 of the mouthpiece assembly. Additionally or alternatively, crimping portion 66 may be adjacent crimping region 44 of the mouthpiece assembly and adapted to engage and crimp the crimping region to prevent, or at least restrict, the flow of drink liquid through the liquid passage when the mouthpiece assembly is in the stowed configuration. That is, the crimping portion of the cap assembly may engage and facilitate the crimping region's folding upon and/or over itself when the mouthpiece assembly is reconfigured from the dispensing configuration to the stowed configuration. Crimping portion 66 may include any suitable structure, such as a lip, a flange, an edge, or any other structure that engages, either directly or indirectly, the crimping region of the mouthpiece assembly and facilitates crimping thereof when the mouthpiece assembly is reconfigured to the stowed configuration. For example, the crimping portion of the cap assembly may be defined by a portion, such as a lip or opening, of the through-passage 34. Other configurations are also within the scope of the present disclosure.

Drink containers 10 according to the present disclosure may include an optional straw 68 that is integral to or selectively coupled to, either directly or indirectly, the mouthpiece assembly and that extends into the liquid container, such as to (or at least proximate) a lower (internal) region of the liquid container. When present, straw 68 may enable a user to draw drink liquid from the drink container via outlet 42 without having to tip the drink container so that drink liquid may flow into the liquid passage 36. For example, some users may prefer to draw drink liquid from the drink bottle without having to lift and tilt the drink container to the generally horizontal or even inverted configuration that would be used if straw 68 were not present. Additionally or alternatively, some users may prefer or find it easier to draw drink liquid from the drink container using straw 68 rather than having to lift and tip the drink container.

Cap assemblies 14 according to the present disclosure optionally may include a collar member 70, as schematically represented in the example illustrated in FIGS. 3-4. In some embodiments, the collar member may be rigid or at least semi-rigid. In some examples of cap assemblies 14, the collar member 70, when present, may (but is not required to) be described as a component, or sub-part, of mouthpiece assembly 18. When present, the collar member may be pivotally coupled to the base or another portion of the cap assembly. In such examples, the cap assemblies may be described as including a hinge arrangement between the collar member and the base of the cap assembly such that the collar member together with at least a portion of the mouthpiece assembly may be pivoted from the stowed configuration to the dispensing configuration, as indicated by an arrow in FIG. 4, and vice versa. In such examples, the optional crimping portion 66 of the cap assembly may be defined by at least a portion of the collar member. In some examples, the collar member may be described as being external to the liquid passage defined by the mouthpiece assembly. Additionally or alternatively, collar members according to the present disclosure may surround, at least partially surround, encircle, or at least partially encircle a portion of the mouthpiece assembly, such as the crimping region of the mouthpiece assembly. Additionally or alternatively, collar members according to the present disclosure may include more than one discrete component, with at least one or more such discrete components being generally adjacent a portion of the mouthpiece assembly, including the crimping region of the mouthpiece assembly. Collar members according to the present disclosure also may be described as pivoting members or crimping members.

In examples of drink containers 10 that include a collar member 70, second catch structure 56 of mouthpiece securing mechanism 52 may be (but is not required to be) integral to, part of, or otherwise disposed on the collar member. Additionally or alternatively, examples of drink containers according to the present disclosure that include collar member 70 may include a second catch structure 56 that is integral to, part of, or otherwise disposed on a portion of, or another portion of, the mouthpiece assembly.

Figure 5:
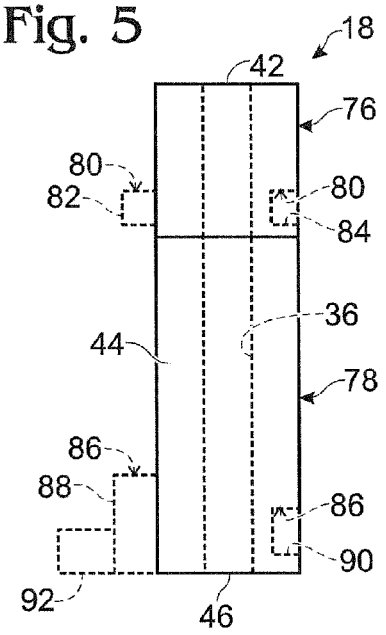
FIG. 5 is a schematic illustration of at least a portion of a mouthpiece assembly according to the present disclosure.

FIG. 5 schematically depicts an illustrative, non-exclusive example of a mouthpiece assembly 18, or at least a portion thereof, according to the present disclosure, which may be used with any drink container 10 and/or cap assembly 14 according to the present disclosure. As discussed, a mouthpiece assembly according to the present disclosure may optionally include a collar member. As illustrated and discussed, mouthpiece assembly 18 defines liquid passage 36 through which drink liquid may selectively flow, and further defines inlet 46 and outlet 42 of the liquid passage.

FIG. 5 graphically illustrates that mouthpiece assemblies 18 according to the present disclosure (including those depicted in FIGS. 1-4) include at least a mouthpiece portion 76 and a tube, or tube portion, 78. Mouthpiece portion 76 includes outlet 42 and is adapted to permit a user to selectively receive and consume drink liquid from the drink container. Mouthpiece portion 76 may take a variety of configurations including (but not limited to) mouthpiece portions that include a user-actuated valve adapted to permit selective dispensing of drink liquid from the drink container, mouthpiece portions that permit a user to draw, or suck, drink liquid from the drink container, mouthpiece portions that permit a user to squeeze drink liquid from the drink container, and/or other configurations of mouthpiece portions. Illustrative, non-exclusive examples of mouthpiece portions, including bite-actuated mouthpieces, that may be utilized with or incorporated into mouthpiece assemblies according to the present disclosure are disclosed in U.S. Patent Application Publication No. 2006/0226110, incorporated herein.

In examples of mouthpiece portions that include a user-actuated valve, such as a bite-actuated valve, the user-actuated valve may restrict dispensing of liquid from the liquid container even though the mouthpiece assembly may be in the dispensing configuration. When the mouthpiece portion includes a bite-actuated valve, which refers to a valve that is urged from a closed configuration to an open configuration by a user biting upon the valve (such as opposed sidewalls thereof) the mouthpiece portion may be referred to as a bite-actuated mouthpiece. Bite-actuated valves (and/or bite-actuated mouthpieces) are typically biased to a closed configuration, and thus automatically return from an open configuration to a closed configuration upon release of the compressive forces being applied thereto by a user, such as by a user's teeth and/or mouth.

In examples of drink containers that include a collar member, as discussed, mouthpiece portions according to the present disclosure may (but are not required to) include structure 80 for securing the mouthpiece portion to the collar member. In some such examples, structure 80 may include one or more of a lip, flange, or other protrusion 82 adapted to engage and mate with a corresponding one or more of a channel or depression of the collar member, when present. Additionally or alternatively, structure 80 may include one or more of a channel or depression 84 that defines a seat for, and that is adapted to engage and mate with, a corresponding one or more of a lip, flange, or other protrusion of the collar member, when present. Accordingly, when assembled, structure 80 may restrict relative movement between the mouthpiece portion and the collar member and/or may restrict lateral translation of the collar member relative to the mouthpiece portion. Additionally or alternatively, other portions of mouthpiece assemblies, including the tube portion, may incorporate structure 80. Structure 80 may additionally or alternatively be referred to as mouthpiece-securing structure 80.

Tube 78 defines at least a portion of liquid passage 36 for drink liquid to flow from the internal compartment of the liquid container to mouthpiece portion 76. Tube 78 may include crimping region 44, which, as discussed, may be constructed of a resiliently deformable material and be adapted to prevent, or at least restrict, the flow of drink liquid through the liquid passage when the mouthpiece is in the stowed configuration. In some embodiments, tube 78 may include or define inlet 46 of the liquid passage. In embodiments where the tube does not include or define the inlet of the liquid passage, the tube is in fluid communication with the inlet of the passage.

As discussed, mouthpiece assemblies 18 according to the present disclosure may be adapted for selective anchoring, or coupling, to the base of the cap assembly and/or through the through-passage of the cap assembly. In some such examples, mouthpiece assemblies 18 may include structure for securing the mouthpiece assembly to the base of the cap assembly. For example, the mouthpiece assembly may include an anchor, or anchor portion, 86 that is adapted to prevent, or at least restrict, passing of the anchor portion through the through-passage of the base of the cap assembly. Anchor portion 86 may extend from tube 78 and/or may include a flange 88, at least a portion of which may be sized to prevent, or at least restrict, passing of the anchor portion through the through-passage of the base of the cap assembly. Additionally or alternatively, anchor portion 86 may extend into tube 78 and/or may define a channel, depression, or other recess 90 that is sized and shaped to engage and mate with corresponding structure of the base of the cap assembly. Anchor portion 86 may, but is not required to, define the inlet to the liquid passage through the mouthpiece assembly. Anchor portions 86 and/or tubes 78 according to the present disclosure may further include (but are not required to include) an, or an additional, tab, or flange, 92 shaped, sized, or otherwise adapted for a user to grasp and thereby remove the mouthpiece assembly from the base of the cap assembly. Mouthpiece assemblies that include such an anchor portion may be described as being configured to be selectively coupled to and decoupled from the base of the cap assembly via an underside of the base, and thus not from a top side of the cap assembly.

Turning now to FIGS. 6-13, an illustrative, non-exclusive example of a drink container 10 according to the present disclosure and various component parts thereof are illustrated. Where appropriate, the reference numerals from the schematic illustrations of FIGS. 1-5 are used to designate corresponding parts of drink containers 10 according to the present disclosure; however, the examples of FIGS. 6-13 are non-exclusive and do not limit the present disclosure to the illustrated embodiment. That is, neither drink containers nor various component parts thereof are limited to the specific embodiment disclosed and illustrated in FIGS. 6-13, and drink containers according to the present disclosure may incorporate any number of the various aspects, configurations, characteristics, properties, etc. illustrated in the embodiment of FIGS. 6-13, of FIGS. 1-4, as well as variations thereof and without requiring the inclusion of all such aspects, configurations, characteristics, properties, etc. For the purpose of brevity, each previously discussed component part, or variant thereof, may not be discussed again with respect to FIGS. 6-13; however, it is within the scope of the present disclosure that the previously discussed features, materials, variants, etc. may be utilized with the illustrated embodiment of FIGS. 6-13. Similarly, it is also within the scope of the present disclosure that all of the component parts, and portions thereof, that are illustrated in FIGS. 6-13 are not required to all embodiments according to the present disclosure.

Figure 6:
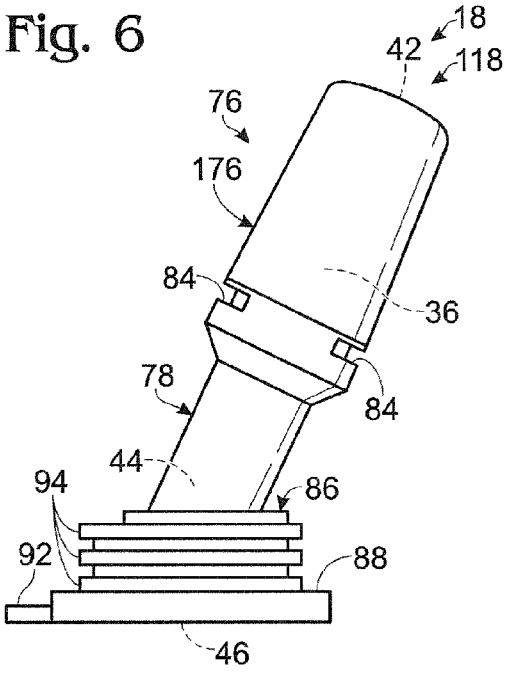
FIG. 6 is a side view of an illustrative, non-exclusive example of at least a portion of a mouthpiece assembly according to the present disclosure.

An illustrative, non-exclusive example of a mouthpiece assembly 18, or at least a portion thereof, that may be used with drink containers 10 according to the present disclosure is illustrated in FIG. 6 and generally indicated at 118. Mouthpiece assembly 118 is illustrated without an optional corresponding collar member; however, it is within the scope of the present disclosure that mouthpiece assembly 118 may further include a collar member, such as any of the collar members disclosed elsewhere herein. Mouthpiece assembly 118 includes a mouthpiece portion 76 in the form of a bite-actuated mouthpiece 176, a tube 78, and an anchor portion 86. The bite-actuated mouthpiece, the tube, and the anchor portion collectively define a liquid passage 36, with liquid passage 36 including an inlet 46 and an outlet 42. Tube 78 includes a crimping region 44.

Figure 9:
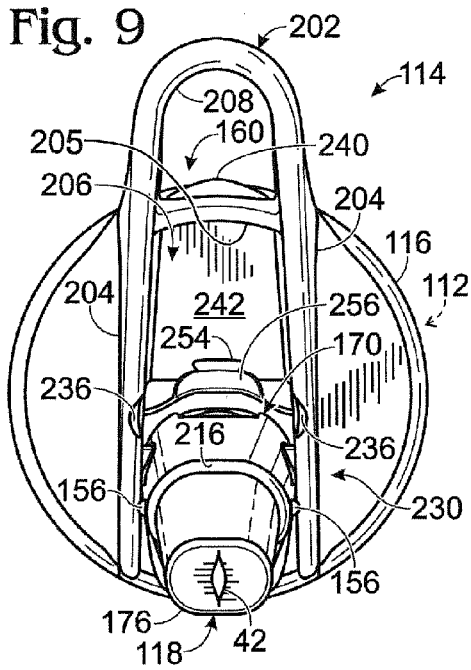
FIG. 9 is a top view of the cap assembly of the drink container of FIG. 7 with the cap assembly's mouthpiece assembly in its dispensing configuration.

As illustrated, bite-actuated mouthpiece 176 includes outlet 42, through which drink liquid may be selectively dispensed. FIG. 9 illustrates the bite-actuated mouthpiece in an open, or dispensing, configuration with the outlet open to permit drink liquid to be dispensed therethrough, for example, as configured when a user applies opposing forces thereto with his/her teeth and/or lips. Bite-actuated mouthpiece 176 also includes a pair of channels 84 (as perhaps best seen in FIG. 11) that are adapted to engage and mate with corresponding structure of a collar member.

Anchor portion 86 includes a flange 88 sized and shaped to prevent, or at least restrict, mouthpiece assembly 118 from passing through a corresponding through-passage of a base of a cap assembly. Anchor portion 86 further includes three additional flanges, or ribs, 94 that are sized and shaped to provide a friction-fit arrangement with a through-passage of a corresponding base of a cap assembly. Anchor portion 86 also includes a tab 92 sized and shaped for a user to grasp and thereby remove the mouthpiece portion, the tube, and the anchor portion from a base of a corresponding cap assembly by urging the mouthpiece assembly downward and away from the underside of the cap assembly.

The illustrative, non-exclusive bite-actuated mouthpiece 176, tube 78, and anchor portion 86 of mouthpiece assembly 118 illustrated in FIG. 6 are constructed as a unitary assembly of a resiliently deformable material. As illustrated, the mouthpiece portion has a greater exterior perimeter than the tube, and the anchor portion has a greater exterior perimeter than the tube and the mouthpiece portion. This unitary construction and the illustrative, non-exclusive relative sizes are not required in all embodiments, and other configurations are within the scope of the present disclosure.

Figure 7:
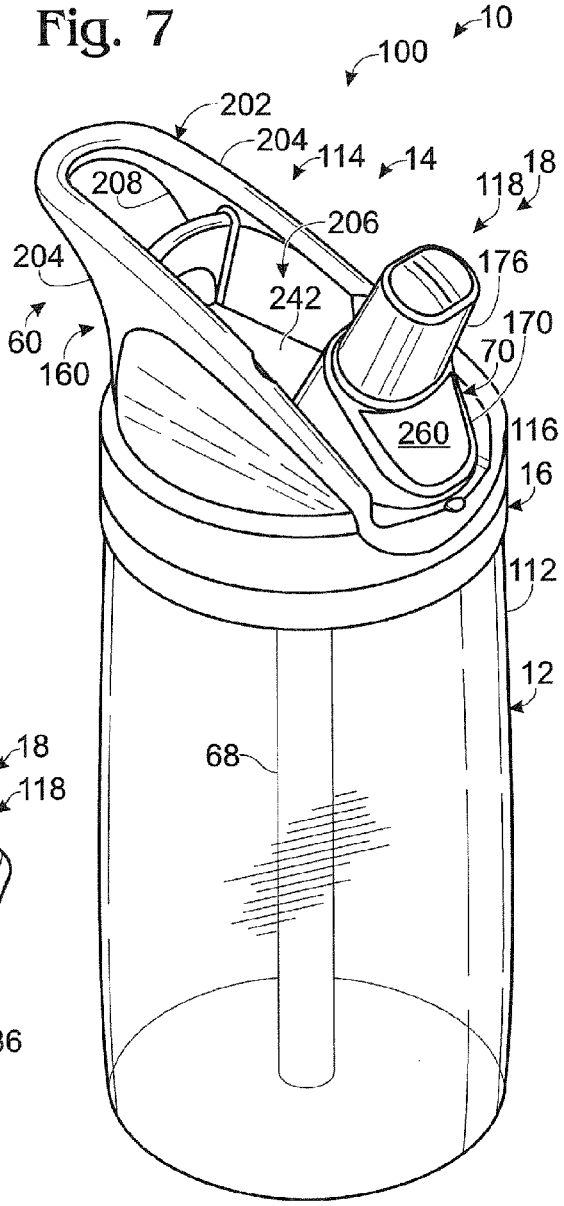
FIG. 7 is an isometric view of an illustrative, non-exclusive example of a drink container according to the present disclosure including the mouthpiece assembly of FIG. 6, with the drink container illustrated with the mouthpiece assembly in its dispensing configuration.
Figure 8:
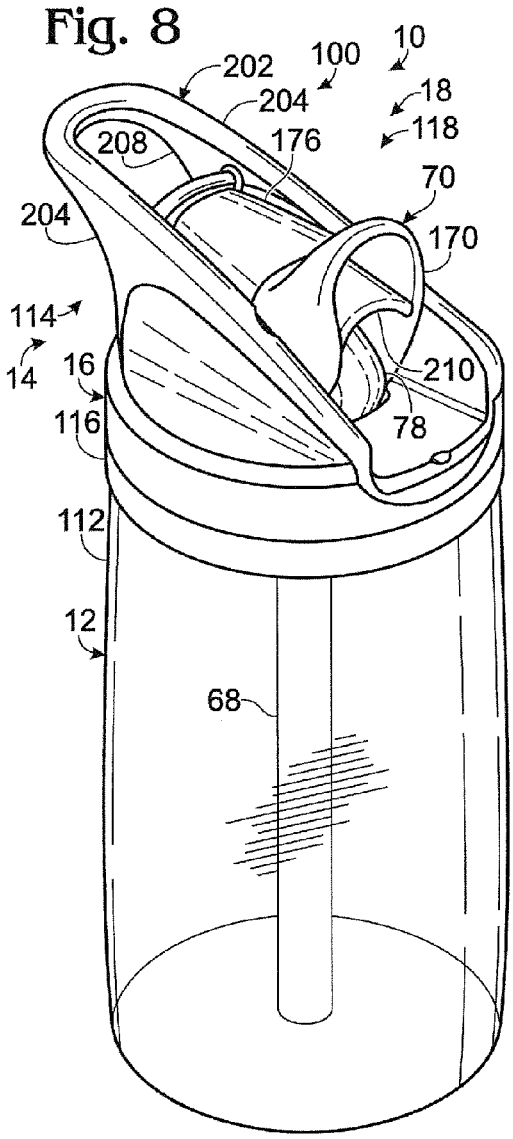
FIG. 8 is an isometric view of the drink container of FIG. 7 with its mouthpiece assembly in its stowed configuration.
Figure 10:
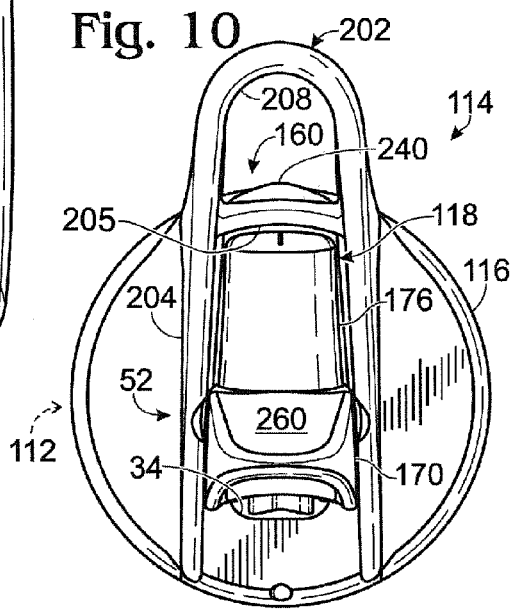
FIG. 10 is a top view of the cap assembly of FIG. 9 with the mouthpiece assembly in its stowed configuration.
Figure 12:
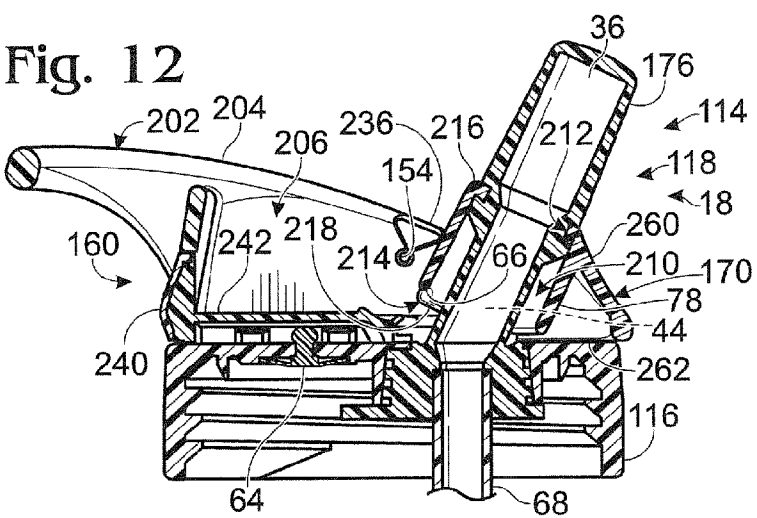
FIG. 12 is a cross-sectional side elevation view of the cap assembly of FIG. 9 with the mouthpiece assembly in its dispensing configuration.
Figure 13:
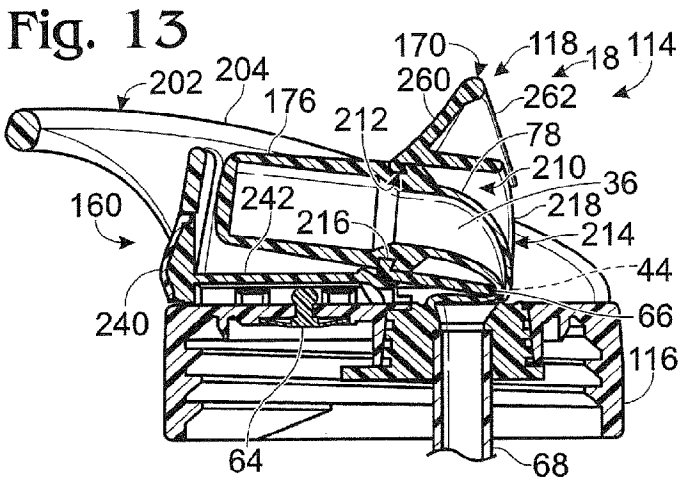
FIG. 13 is a cross-sectional side elevation view of the cap assembly of FIG. 9 with the mouthpiece assembly in its stowed configuration.

An illustrative, non-exclusive example of a drink container 10 including mouthpiece assembly 118 of FIG. 6 is illustrated in FIGS. 7-8, is generally indicated at 100, and may be referred to as a drink bottle 100. Drink bottle 100 includes a liquid container 12 in the form of a rigid bottle 112, and a cap assembly 14 indicated generally at 114. Cap assembly 114 is further illustrated in FIGS. 9-13 with FIGS. 7, 9, and 12 illustrating mouthpiece assembly 118 in a dispensing configuration, and with FIGS. 8, 10, and 13 illustrating mouthpiece assembly 118 in a stowed configuration. In the illustrative non-exclusive example of drink bottle 100, a portion of the mouthpiece assembly is adapted to be selectively pivoted between the dispensing configuration and the stowed configuration, and as discussed, may be biased to pivot automatically to the dispensing configuration when not restrained from moving under this bias.

Cap assembly 114 of drink bottle 100 includes a base 116 that includes a vent 64 in the form of an air return assembly with a pressure-actuated valve, a mouthpiece assembly 118 that includes a collar member 70, and a user release mechanism 60. Cap assembly 114 of drink bottle 100 further includes a handle 202 that projects away from base 116 and that includes a pair of lateral guards 204 that at least partially define a stowing region 206. As illustrated in at least FIGS. 8-10, and as indicated at 205 in FIGS. 9 and 10, the handle also may include a dust cover portion that extends between the lateral guards and which extends across the outlet of the mouthpiece assembly when the mouthpiece assembly is in the stowed configuration. Stowing region 206 is sized and otherwise adapted to receive at least a portion of the mouthpiece assembly between the pair of lateral guards when the mouthpiece assembly is in the stowed configuration. In the non-exclusive example of drink bottle 100, stowing region 206 receives bite-actuated mouthpiece 176 and at least a portion of tube 78. When present, handle 202 may (but is not required to) define a closed perimeter, or boundary, 208 through which a lanyard, karabiner, belt, strap, user's finger, or other structure may extend to hold and/or retain the drink bottle in a selected position. Other configurations of cap assemblies and handles, including cap assemblies without handles, are also within the scope of the present disclosure. It is also within the scope of the present disclosure that other cap assemblies 14 and drink containers 10 may include a handle, including but not limited to the illustrative, non-exclusive example of a handle depicted in FIGS. 7-13.

The illustrative, non-exclusive example of mouthpiece assembly 118 of drink bottle 100 includes an optional rigid collar member 70, which is generally indicated at 170. Rigid collar member 170 defines a through-passage 210 through which tube 78 and a portion of bite-actuated mouthpiece 176 extends. As perhaps best seen in FIGS. 12-13, through-passage 210 is defined by an opening 212 that is distal to the anchor portion of the mouthpiece assembly and an opening 214 that is proximal to the anchor portion of the mouthpiece assembly. Opening 212 is defined by a rim 216 that engages the bite-actuated mouthpiece assembly 176. That is, rim 216 engages and mates with channels 84 of the mouthpiece portion to effectively couple the rigid collar member to the mouthpiece portion and generally restrict lateral translation of the rigid collar member relative to the mouthpiece portion. Accordingly, when the rigid collar member is pivoted, at least the mouthpiece portion of the mouthpiece assembly pivots with it.

Opening 214 of the rigid collar member is defined by a rim 218, which further defines a crimping portion 66. As discussed, crimping portion 66 is adjacent crimping region 44 of tube 78 of the mouthpiece assembly. Accordingly, when the rigid collar member is pivoted from the dispensing configuration to the stowed configuration, the crimping portion 66 engages and crimps the crimping region of the tube to thereby restrict the flow of drink liquid through the liquid passage when the mouthpiece assembly is in the stowed configuration, as perhaps best seen in FIG. 13.

In the illustrated example, the crimping portion of the rigid collar member does not engage the crimping region of the tube when the mouthpiece assembly is in the dispensing configuration, as perhaps best seen in FIG. 12; however, it is within the scope of the present disclosure that the crimping portion of the rigid collar member does engage and even partially crimps the crimping region of the tube when the mouthpiece assembly is in the dispensing configuration, as long as the tube is not crimped to such a degree that drink liquid is prevented from flowing through the liquid passage when the mouthpiece assembly is in the dispensing configuration.

The rigid collar member of drink bottle 100 is pivotally, or hingedly, coupled to the handle of cap assembly 114. Accordingly, handle 202 and rigid collar member 170 collectively define a hinge 230, which is indicated in FIG. 9. Lateral guards 204 each include a cylindrical depression 232 that is sized and shaped to mate with a corresponding cylindrical protrusion 234 extending from opposing sides of the rigid collar member, as perhaps best seen in FIG. 11.

As discussed, cap assemblies 14 according to the present disclosure include a mouthpiece securing mechanism 52 that is adapted to selectively retain the mouthpiece assembly in the stowed configuration. As illustrated, the base of cap assembly 114 includes a first catch structure 54, and the rigid collar member 170 includes a second catch structure 56 that is adapted to engage and mate with the first catch structure when the mouthpiece assembly is in the stowed configuration. The first catch structure of cap assembly 114 includes a pair of cylindrical depressions 154 extending into the lateral guards 204 of the optional handle 202, and the second catch structure of the rigid collar member includes a pair of hemispherical protrusions 156 positioned and sized to mate with the depressions 154 and thereby retain the mouthpiece assembly in its stowed configuration upon a user configuring the mouthpiece assembly to its stowed configuration.

The lateral guards of drink cap assembly 114 further include (but are not required to include) a pair of channels, or depressions, 236 that provide clearance for the hemispherical protrusions 156 to pass when the mouthpiece assembly is reconfigured from the dispensing configuration to the stowed configuration and the first and second catch structures are engaged. Channels 236 may also be described as ramps. When the channels 236 are present, the hemispherical protrusions of the mouthpiece securing mechanism will not be overly worn-down due to engagement and friction with the lateral guards through repeated reconfigurations of the mouthpiece assembly by a user.

Cap assembly 114 of drink bottle 100 includes an optional user release mechanism 60, indicated generally at 160, and which is adapted to permit the reconfiguring of the mouthpiece assembly from the stowed configuration to the dispensing configuration. As perhaps best seen in FIG. 11, user release mechanism 160 of drink bottle 100 includes a sliding member 238. Sliding member 238 includes a user engagement pad 240 and an actuator, such as may be implemented and/or described as a generally planar portion 242, that includes a pair of tabs 244 that slide within a pair of corresponding channels 246 that extend into lateral guards 204 of handle 202. Sliding member 238 is configured to slide relative to the base of the cap assembly upon user actuation of the user release mechanism 160 (i.e., upon user engagement and translation of the user engagement pad 240). Planar portion 242 of sliding member 238 partially defines stowing region 206 together with lateral guards 204 of handle 202.

Sliding member 238 also includes a pair of biasing members 250 that slide within channels 246, and which may be integral with the sliding member. Biasing members 250 may be described as springs or leaf springs and may include arcuate projections, or tabs, that are biased to the positions illustrated in FIG. 11. A pair of wedge-shaped tabs 252 is positioned within the channels 246, and when the sliding member 238 is caused to translate toward tube 78 of the mouthpiece assembly in response to user engagement and translation of the user engagement pad, biasing members 250 are compressed against the wedge-shaped tabs. When the user engagement pad is released by a user, the sliding member is biased, or springs, away from tube 78 of the mouthpiece assembly.

Sliding member 238 includes a collar engagement portion 254 that is adapted to engage the rigid collar member and force disengagement of the first and second catch structures upon actuation of the user release mechanism (i.e., upon engagement and translation of the user engagement pad). The collar engagement portion 254 of drink bottle 100 is in the form of a tab that extends away from the planar portion. Accordingly, upon actuation of user release mechanism 160, the collar engagement portion engages rim 216 of the rigid collar member and forces disengagement of the first and second catch structures. Additionally or alternatively, a collar engagement portion according to the present disclosure may be adapted to translate relative to and wedge the rigid collar member so that the rigid collar member is forced to pivot. Pivoting of the rigid collar member thereby forces disengagement of the first and second catch structures and thus forces the mouthpiece assembly to reconfigure from the stowed configuration to the dispensing configuration due to the bias of the mouthpiece assembly.

Figure 11:
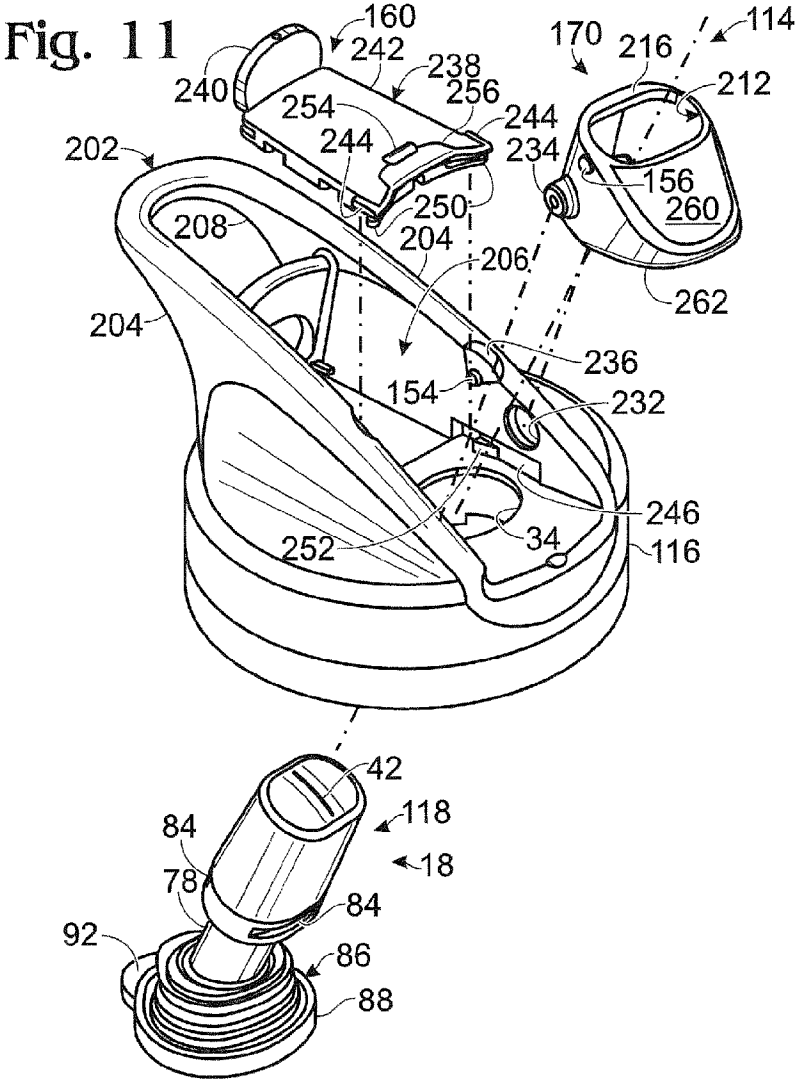
FIG. 11 is an isometric exploded view of the cap assembly of FIG. 9.

Sliding member 238 includes an optional depression 256 that extends into planar portion 242 and adjacent tab 254 (as perhaps best seen in FIG. 11). Depression 256 is sized and shaped to receive at least a portion of the rigid collar member when the mouthpiece assembly is in the stowed configuration.

In addition, or in the alternative, to user release mechanism 160 providing a mechanism for releasing the mouthpiece assembly from the stowed configuration to the dispensing configuration, mouthpiece assemblies according to the present disclosure also may include (but are not required to include) another form of user release mechanism 60. For example, the rigid collar member of drink bottle 100 may include a user engagement portion 260 that, when the mouthpiece assembly is in the stowed configuration, is adapted to receive a user-imparted force that pivots the mouthpiece assembly and thereby forces disengagement of the first and second catch structures of the mouthpiece securing mechanism. User engagement portion 260 may be described as a user release mechanism 60, or at least a portion thereof, according to the present disclosure.

Rigid collar member 170 of drink bottle 100 further includes an optional stop surface 262 that does not engage the base of the cap assembly when the mouthpiece assembly is in the stowed configuration but that does engage the base of the cap assembly when the mouthpiece assembly is in the dispensing configuration. Accordingly, the stop surface may thereby define a dispensing position of the mouthpiece portion. In other words, when the mouthpiece assembly is released from the stowed configuration, the stop surface may prevent the mouthpiece portion from pivoting beyond its intended position for dispensing drink liquid therefrom. Accordingly, the stop surface further prevents the tube of the mouthpiece assembly from folding over on itself, or crimping, in a direction opposite from the intended stowed configuration in which crimping of the tube is desired. Therefore, when a user is consuming drink liquid from the mouthpiece, the user may be prevented from accidentally restricting the liquid passage simply by imparting a pivoting force on the mouthpiece assembly away from the stowed configuration.

As seen in FIGS. 12-13, straw 68, when present, may be sized to be received within at least a portion of the liquid passage 36 of the mouthpiece assembly in a friction fit arrangement. Other configurations are also within the scope of the present disclosure.

The following lettered paragraphs represent non-exclusive ways of describing inventions according to the present disclosure.

A. A drink container, comprising:

a liquid container having a neck with an opening and having an internal compartment sized to hold a volume of potable drink liquid;

a cap assembly removably coupled to the liquid container, the cap assembly comprising:

a base removably coupled to the neck of the liquid container and including a through-passage;

a first catch structure;

a mouthpiece assembly extending through the through-passage of the base and defining a liquid passage through which drink liquid from the liquid container may selectively flow, and further defining an inlet through which drink fluid in the internal compartment may enter the liquid passage and an outlet through which drink liquid from the internal compartment of the liquid container is selectively dispensed, wherein the mouthpiece assembly is configured to be selectively configured between a dispensing configuration, in which the liquid passage permits drink liquid to flow from the internal compartment at least into the liquid passage, and a stowed configuration, in which the liquid passage restricts the flow of drink liquid through the liquid passage, wherein the mouthpiece assembly is biased to the dispensing configuration, and wherein the mouthpiece assembly comprises:

a mouthpiece portion that includes the outlet;

a tube that defines at least a portion of the liquid passage for drink liquid to flow from the internal compartment to the mouthpiece portion, wherein the tube includes a crimping region constructed of a resiliently deformable material and is adapted to restrict the flow of drink liquid through the liquid passage when the mouthpiece assembly is in the stowed configuration; and a second catch structure adapted to be selectively engaged with the first catch structure to retain the mouthpiece assembly in the stowed configuration; and a user release mechanism adapted to automatically disengage the first and second catch structures upon actuation of the user release mechanism and thereby release the mouthpiece assembly to move via its bias from the stowed configuration to the dispensing configuration.

A1 The drink container of paragraph A, wherein the user release mechanism includes a mouthpiece assembly engagement portion adapted to engage the mouthpiece assembly and force disengagement of the first and second catch structures upon actuation of the user release mechanism.

A2 The drink container of any preceding paragraph, wherein the mouthpiece assembly further includes a rigid collar member that is pivotally coupled to the base and which includes a crimping portion; wherein the crimping portion is adjacent the crimping region of the tube and external of the liquid passage, wherein the rigid collar member engages and crimps the crimping region to restrict the flow of drink liquid through the liquid passage when the mouthpiece assembly is in the stowed configuration.

A2.1 The drink container of paragraph A2, wherein the rigid collar member includes the second catch structure, and further wherein the user release mechanism includes a collar engagement portion that is adapted to engage the rigid collar member and force disengagement of the first and second catch structures upon actuation of the user release mechanism.

A2.1.1 The drink container of paragraph A2.1, wherein when the mouthpiece assembly is in the stowed configuration and upon actuation of the user release mechanism, the collar engagement portion is adapted to translate relative to and wedge the rigid collar member to force the rigid collar member to pivot.

A2.2 The drink container of paragraph A2, wherein the rigid collar member is engaged with the mouthpiece portion.

A2.2.1 The drink container of paragraph A2.2, wherein the rigid collar member does not engage the tube when the mouthpiece assembly is in the dispensing configuration.

A2.2.2 The drink container of paragraph A2.2, wherein the mouthpiece portion includes a seat for the rigid collar member in which the rigid collar member engages the mouthpiece portion, wherein the seat restricts relative movement between the mouthpiece portion and the rigid collar member.

A2.3 The drink container of paragraph A2, wherein the rigid collar member includes a user engagement portion, wherein when the mouthpiece assembly is in the stowed configuration and upon a user imparted force on the user engagement portion that pivots the rigid collar member, the first and second catch structures disengage and thereby release the mouthpiece assembly to move via its bias from the stowed configuration to the dispensing configuration.

A2.4 The drink container of paragraph A2, wherein the rigid collar member includes a stop surface that does not engage the base of the cap assembly when the mouthpiece assembly is in the stowed configuration and that engages the base of the cap assembly when the mouthpiece assembly is in the dispensing configuration to define a dispensing position of the mouthpiece portion.

A3 The drink container of any preceding paragraph, wherein the crimping region at least partially biases the mouthpiece assembly to the dispensing configuration.

A4 The drink container of any preceding paragraph, wherein the mouthpiece portion and the tube are constructed as a unitary assembly of the resiliently deformable material.

A4.1 The drink container of any preceding paragraph, wherein the mouthpiece assembly further includes an anchor portion extending from the tube, wherein the anchor portion is sized to restrict passage of the anchor portion through the through-passage of the base of the cap assembly.

A6 The drink container of any preceding paragraph, wherein the cap assembly further includes a handle that projects away from the base of the cap assembly, wherein the handle includes a pair of lateral guards that at least partially define a stowing region that receives at least a portion of the mouthpiece assembly between the pair of lateral guards when the mouthpiece assembly is in the stowed configuration.

A6.1 The drink container of paragraph A6, wherein the stowing region is at least partially defined by a portion of the user release mechanism.

A6.1.1 The drink container of paragraph A6.1, wherein the user release mechanism includes an actuator that is configured to slide relative to the base of the cap assembly upon user actuation of the user release mechanism, wherein the stowing region is defined by at least the pair of lateral guards and the actuator of the user release mechanism.

A7 The drink container of any preceding paragraph, wherein the mouthpiece assembly is configured to be selectively coupled to and decoupled from an operative position on the base of the cap assembly via an underside of the base but not via a top side of the base.

A7.1 The drink container of paragraph A7, wherein the mouthpiece assembly further includes an anchor portion extending from the tube, wherein the anchor portion is sized to restrict passage of the anchor portion through the through-passage of the base of the cap assembly.

A7.1.1 The drink container of paragraph A7.1, wherein the mouthpiece portion, the tube, and the anchor portion are constructed as a unitary assembly of the resiliently deformable material.

A8 The drink container of any preceding paragraph, wherein the mouthpiece portion includes a bite-actuated mouthpiece.

A8.1 The drink container of paragraph A8, wherein the mouthpiece portion and the tube are constructed as a unitary assembly of the resiliently deformable material.

B. A drink container, comprising:

a liquid container having a neck with an opening and having an internal compartment sized to hold a volume of potable drink liquid;

a cap assembly removably coupled to the liquid container, the cap assembly comprising:

a base removably coupled to the neck of the liquid container and including a through-passage;

a mouthpiece assembly extending through the through-passage of the base and defining a liquid passage through which drink liquid from the liquid container may selectively flow, and further defining an outlet through which drink liquid is selectively dispensed, wherein the mouthpiece assembly is configured to be selectively configured between a dispensing configuration, in which the liquid passage permits drink liquid to flow from the internal compartment, and a stowed configuration, in which the liquid passage restricts the flow of drink liquid through the liquid passage, wherein the mouthpiece assembly is biased to the dispensing configuration, and wherein the mouthpiece assembly comprises:

a mouthpiece portion including the outlet;

a tube that defines at least a portion of the liquid passage for drink liquid to flow from the internal compartment to the mouthpiece portion, wherein the tube includes a crimping region constructed of a resiliently deformable material and is adapted to restrict the flow of drink liquid through the liquid passage when the mouthpiece assembly is in the stowed configuration, wherein the mouthpiece portion and the tube are constructed as a unitary assembly of the resiliently deformable material; and a rigid collar member pivotally coupled to the base and including a crimping portion adjacent the crimping region of the tube and adapted to engage and crimp the crimping region to restrict the flow of drink liquid through the liquid passage when the mouthpiece assembly is in the stowed configuration;

a mouthpiece securing mechanism adapted to selectively retain the mouthpiece assembly in the stowed configuration; and a user release mechanism adapted to automatically release the mouthpiece assembly to move via its bias from the stowed configuration to the dispensing configuration.

B1 The drink container of paragraph B, wherein the mouthpiece portion includes a bite-actuated mouthpiece.

B2 The drink container of any of paragraphs B-B1, wherein the mouthpiece assembly further includes an anchor portion extending from the tube, wherein the anchor portion is sized to restrict passage of the anchor portion through the through-passage of the base of the cap assembly.

B2.1 The drink container of paragraph B2, wherein the mouthpiece portion, the tube, and the anchor portion are constructed as a unitary assembly of the resiliently deformable material.

B3 The drink container of any of paragraphs B-B2.1, wherein the rigid collar member is engaged with the mouthpiece portion.

B3.1 The drink container of paragraph B3, wherein the rigid collar member does not engage the tube when the mouthpiece assembly is in the dispensing configuration.

B3.1.1 The drink container of paragraph B3.1, wherein the mouthpiece portion includes a seat for the rigid collar member, with the rigid collar member engaging the mouthpiece portion therein, wherein the seat restricts relative movement between the mouthpiece portion and the rigid collar member.

B4 The drink container of any of paragraphs B-B3.1.1, wherein the rigid collar member includes a user engagement portion, wherein when the mouthpiece assembly is in the stowed configuration and upon a user imparted force on the user engagement portion that pivots the rigid collar member, the mouthpiece assembly is released from the stowed configuration.

B5 The drink container of any of paragraphs B-B4, wherein the rigid collar member includes a stop surface that does not engage the base of the cap assembly when the mouthpiece assembly is in the dispensing configuration and that engages the base of the cap assembly when the mouthpiece assembly is in the dispensing configuration to define a dispensing position of the mouthpiece portion.

C. A drink container, comprising a liquid container having a neck with an opening and having an internal compartment sized to hold a volume of potable drink liquid;

a cap assembly removably coupled to the liquid container, the cap assembly comprising:

- a base removably coupled to the neck of the liquid container and including a through-passage;
- a mouthpiece assembly extending through the through-passage of the base and defining a liquid passage, wherein the mouthpiece assembly is configured to be selectively configured between a dispensing configuration in which the liquid passage permits drink liquid to flow from the internal compartment for consumption by a user and a stowed configuration in which the liquid passage restricts the flow of drink liquid through the liquid passage, wherein the mouthpiece assembly is biased to the dispensing configuration, and wherein the mouthpiece assembly comprises:
  - a mouthpiece portion including an outlet through which drink liquid from the internal compartment may be dispensed when the mouthpiece assembly is in the dispensing configuration; and
  - means for selectively restricting the flow of drink liquid through the liquid passage when the mouthpiece assembly is in the stowed configuration;
- means for selectively securing the mouthpiece assembly in the stowed configuration; and
- means for automatically releasing the mouthpiece assembly from the stowed configuration to the dispensing configuration in response to a user input.

C1 The drink container of paragraph C, wherein the mouthpiece assembly is a bite-actuated mouthpiece that is biased to a closed configuration through which drink liquid may not flow.

C2 The drink container of any of paragraphs C-C1, wherein the mouthpiece portion and the means for selectively restricting are a unitary assembly of a resiliently deformable material.

C3 The drink container of paragraph C2, wherein the mouthpiece assembly further includes an anchor portion, wherein the anchor portion is sized to restrict passage of the anchor portion through the through-passage of the base of the cap assembly, and wherein the unitary assembly includes the anchor portion.

D. A mouthpiece assembly that defines a liquid passage through which drink liquid from a liquid container may selectively flow, comprising:

a mouthpiece portion that defines an outlet to the mouthpiece assembly through which drink fluid may be selectively dispensed;

a tube that defines at least a portion of the liquid passage for drink liquid to flow from the liquid container to the mouthpiece portion, wherein the tube is at least partially constructed of a resiliently deformable material; and an anchor portion extending from the tube, wherein the anchor portion is adapted to secure the mouthpiece assembly to a cap assembly of a liquid container;

wherein one of the tube and the anchor portion defines an inlet to the mouthpiece assembly through which drink fluid may selectively enter the liquid passage.

D1 The mouthpiece assembly of paragraph D, wherein the mouthpiece portion and the tube are constructed as a unitary assembly of the resiliently deformable material.

D2 The mouthpiece assembly of paragraph D, wherein the mouthpiece assembly, the tube, and the anchor portion are constructed as a unitary assembly of the resiliently deformable material.

D3 The mouthpiece assembly of any of paragraphs D-D2, wherein the mouthpiece portion has a greater exterior perimeter than the tube and the anchor portion has a greater exterior perimeter than the tube.

D4 The mouthpiece assembly of any of paragraphs D-D3, wherein the tube includes a crimping region constructed of the resiliently deformable material and is adapted to restrict the flow of drink fluid through the liquid passage when the tube is crimped.

D5 The mouthpiece assembly of any of paragraphs D-D4, wherein the mouthpiece assembly is configured to be selectively configured between a dispensing configuration, in which the liquid passage permits drink liquid to flow from the liquid container at least into the liquid passage, and a stowed configuration, in which the liquid passage restricts the flow of drink liquid through the liquid passage, wherein the mouthpiece assembly is biased to the dispensing configuration.

D5.1 The mouthpiece assembly of paragraph D5, wherein the tube at least partially biases the mouthpiece assembly to the dispensing configuration.

D6 The mouthpiece assembly of any of paragraphs D-D5.1, wherein the mouthpiece portion includes a user-actuated valve.

D7 The mouthpiece assembly of any of paragraphs D-D6, wherein the mouthpiece portion includes a bite-actuated mouthpiece.

E A cap assembly, comprising:

a base adapted to be removably coupled to a liquid container and including a through-passage; and a mouthpiece assembly according to any of paragraphs D-D7 and extending though the through-passage of the base.

E1 The cap assembly of paragraph E, wherein the mouthpiece assembly is configured to be selectively configured between a dispensing configuration, in which the liquid passage permits drink liquid to flow from the internal compartment at least into the liquid passage, and a stowed configuration, in which the liquid passage restricts the flow of drink liquid through the liquid passage, wherein the mouthpiece assembly is biased to the dispensing configuration;

wherein the cap assembly includes a first catch structure; and wherein the mouthpiece assembly includes a second catch structure adapted to be selectively engaged with the first catch structure to retain the mouthpiece assembly in the stowed configuration.

E2 The cap assembly of paragraph E1, wherein the cap assembly further includes a user release mechanism to automatically disengage the first and second catch structures upon actuation of the user release mechanism and thereby release the mouthpiece assembly to move via its bias from the stowed configuration to the dispensing configuration.

E2.1 The cap assembly of paragraph E2, wherein the user release mechanism includes a mouthpiece assembly engagement portion adapted to engage the mouthpiece assembly and force disengagement of the first and second catch structures upon actuation of the user release mechanism.

E2.2 The cap assembly of any of paragraphs E-E2.1, wherein the tube include a crimping region;

wherein the mouthpiece assembly further includes a rigid collar member that is pivotally coupled to the base and which includes a crimping portion, wherein the crimping portion is adjacent the crimping region of the tube and external of the liquid passage, wherein the rigid collar member engages and crimps the crimping region to restrict the flow of drink liquid through the liquid passage when the mouthpiece assembly is in the stowed configuration.

E2.2.1 The cap assembly of paragraph E2.2, wherein the rigid collar member includes the second catch structure, and further wherein the user release mechanism includes a collar engagement portion that is adapted to engage the rigid collar member and force disengagement of the first and second catch structures upon actuation of the user release mechanism.

E2.2.1.1 The cap assembly of paragraph E2.2 or E2.2.1, wherein when the mouthpiece assembly is in the stowed configuration and upon actuation of the user release mechanism, the collar engagement portion is adapted to translate relative to and wedge the rigid collar member to force the rigid collar member to pivot.

E2.2.2 The cap assembly of any of paragraphs E2.2-E2.2.1.1, wherein the rigid collar member is engaged with the mouthpiece portion.

E2.2.2.1 The cap assembly of any of paragraphs E2.2-E2.2.2, wherein the rigid collar member does not engage the tube when the mouthpiece assembly is in the dispensing configuration.

E2.2.2.2 The cap assembly of any of paragraphs E2.2-E2.2.2.1, wherein the mouthpiece portion includes a seat for the rigid collar member in which the rigid collar member engages the mouthpiece portion, wherein the seat restricts relative movement between the mouthpiece portion and the rigid collar member.

E2.2.3 The cap assembly of any of paragraphs E2.2-E2.2.2.2, wherein the rigid collar member includes a user engagement portion, wherein when the mouthpiece assembly is in the stowed configuration and upon a user imparted force on the user engagement portion that pivots the rigid collar member, the first and second catch structures disengage and thereby release the mouthpiece assembly to move via its bias from the stowed configuration to the dispensing configuration.

E2.2.4 The cap assembly of any of paragraphs E2.2-E2.2.3, wherein the rigid collar member includes a stop surface that does not engage the base of the cap assembly when the mouthpiece assembly is in the stowed configuration and that engages the base of the cap assembly when the mouthpiece assembly is in the dispensing configuration to define a dispensing position of the mouthpiece portion.

E3 The cap assembly of any of paragraphs E-E2.2.4, wherein the mouthpiece assembly is configured to be selectively configured between a dispensing configuration, in which the liquid passage permits drink liquid to flow from the internal compartment at least into the liquid passage, and a stowed configuration, in which the liquid passage restricts the flow of drink liquid through the liquid passage, wherein the mouthpiece assembly is biased to the dispensing configuration; and wherein the cap assembly further comprises:

a handle that projects away from the base of the cap assembly, wherein the handle includes a pair of lateral guards that at least partially define a stowing region that receives at least a portion of the mouthpiece assembly between the pair of lateral guards when the mouthpiece assembly is in the stowed configuration.

E4 The cap assembly of any of paragraphs E-E3, wherein the mouthpiece assembly is configured to be selectively coupled to and decoupled from an operative position on the base of the cap assembly via an underside of the base but not via a top side of the base.

In the event that any of the references that are incorporated by reference herein define a term in a manner or are otherwise inconsistent with either the non-incorporated disclosure of the present application or with any of the other incorporated references, the non-incorporated disclosure of the present application shall control and the term or terms as used therein only control with respect to the patent document in which the term or terms are defined.

The disclosure set forth above encompasses multiple distinct inventions with independent utility. While each of these inventions has been disclosed in a preferred form or method, the specific alternatives, embodiments, and/or methods thereof as disclosed and illustrated herein are not to be considered in a limiting sense, as numerous variations are possible. The present disclosure includes all novel and non-obvious combinations and subcombinations of the various elements, features, functions, properties, methods and/or steps disclosed herein. Similarly, where any disclosure above or claim below recites "a" or "a first" element, step of a method, or the equivalent thereof, such disclosure or claim should be understood to include one or more such elements or steps, neither requiring nor excluding two or more such elements or steps.

Inventions embodied in various combinations and subcombinations of features, functions, elements, properties, steps and/or methods may be claimed through presentation of new claims in a related application. Such new claims, whether they are directed to a different invention or directed to the same invention, whether different, broader, narrower, or equal in scope to the original claims, are also regarded as included within the subject matter of the present disclosure.

INDUSTRIAL APPLICABILITY

The drink containers of the present disclosure are applicable to the hydration fields, and are specifically applicable to portable drink containers from which users may selectively drink potable drink liquid.

The invention claimed is:

1. A drink container, comprising:

a liquid container having a neck with an opening and having an internal compartment sized to hold a volume of potable drink liquid; and a cap assembly removably coupled to the liquid container, the cap assembly comprising:

a base removably coupled to the neck of the liquid container and including a through-passage extending through the base;

a first catch structure coupled to the base;

a mouthpiece assembly extending through the through-passage of the base and defining a liquid passage through which drink liquid from the liquid container may selectively flow, and further defining an inlet through which drink liquid in the internal compartment may enter the liquid passage and an outlet through which drink liquid from the internal compartment of the liquid container is selectively dispensed from the liquid passage;

wherein the mouthpiece assembly is configured to be selectively positioned between a dispensing configuration, in which the liquid passage permits drink liquid to flow from the internal compartment at least into the liquid passage, and a stowed configuration, in which the liquid passage restricts the flow of drink liquid through the liquid passage;

wherein the mouthpiece assembly is biased to the dispensing configuration;

wherein the mouthpiece assembly comprises a mouthpiece portion, an anchor portion, and a tube portion that extends between the mouthpiece portion and the anchor portion, wherein the mouthpiece portion, the tube portion, and the anchor portion are constructed as a unitary assembly;

wherein the mouthpiece portion that includes the outlet;

wherein the tube portion defines at least a portion of the liquid passage for drink liquid to flow from the internal compartment to the mouthpiece portion;

wherein the tube portion includes a crimping region constructed of a resiliently deformable material;

wherein the crimping region is configured to restrict the flow of drink liquid through the liquid passage when the mouthpiece assembly is in the stowed configuration;

wherein the anchor portion is sized to restrict passage of the anchor portion through the through-passage of the base of the cap assembly; and further wherein the mouthpiece assembly includes a rigid collar member that is pivotally coupled to the base; wherein the tube portion of the mouthpiece assembly extends through the rigid collar member; and wherein the rigid collar member includes a second catch structure configured to be selectively engaged with the first catch structure to retain the mouthpiece assembly in the stowed configuration; and a user release mechanism configured to automatically disengage the first and second catch structures upon actuation of the user release mechanism and thereby release the mouthpiece assembly to move via its bias from the stowed configuration to the dispensing configuration; wherein the base of the cap assembly defines a pair of opposed channels; wherein the user release mechanism includes a sliding member that is configured to reversibly translate along the base to selectively disengage the first and the second catch structures; wherein the sliding member includes a pair of opposed tabs that slide within the pair of opposed channels as the sliding member translates along the base; wherein the user release mechanism further includes a user engagement pad that is coupled to the sliding member for selective engagement by a user; and further wherein the user release mechanism includes at least one biasing member that urges the sliding member and user engagement pad away from a position where the sliding member disengages the first and the second catch structures.

2. The drink container of claim 1, wherein the mouthpiece portion, the tube portion, and the anchor portion are constructed as a unitary assembly of the resiliently deformable material.

3. The drink container of claim 1, wherein the user release mechanism is mechanically connected to the first catch structure.

4. The drink container of claim 1, wherein the base includes a sidewall with an aperture, and wherein the user engagement pad is in the form of a push button that extends through the aperture.

5. The drink container of claim 1, wherein the sliding member further includes a collar engagement portion with a tab that projects away from the sliding member for selective engagement with the second catch structure.

6. The drink container of claim 5, wherein when the mouthpiece assembly is in the stowed configuration and upon actuation of the user release mechanism, the collar engagement portion is configured to translate relative to the rigid collar member and cause the first catch structure to disengage the second catch structure and thus permit the rigid collar member to pivot due to the bias of the mouthpiece assembly.

7. The drink container of claim 6, wherein the mouthpiece portion includes a seat for the rigid collar member in which the rigid collar member engages the mouthpiece portion, wherein the seat restricts relative movement between the mouthpiece portion and the rigid collar member.

8. The drink container of claim 1, wherein the rigid collar member includes a stop surface that does not engage the base of the cap assembly when the mouthpiece assembly is in the stowed configuration and that engages the base of the cap assembly when the mouthpiece assembly is in the dispensing configuration to define a dispensing position of the mouthpiece portion.

9. The drink container of claim 1, wherein the crimping region at least partially biases the mouthpiece assembly to the dispensing configuration.

10. The drink container of claim 1, wherein the cap assembly further includes a handle that projects away from the base of the cap assembly and a pair of lateral guards that at least partially define a stowing region that receives at least a portion of the mouthpiece assembly between the pair of lateral guards when the mouthpiece assembly is in the stowed configuration.

11. The drink container of claim 10, wherein the handle further includes a dust cover portion that extends between the lateral guards and which extends across the outlet when the mouthpiece assembly is in the stowed configuration.

12. The drink container of claim 1, wherein the mouthpiece portion includes a bite-actuated mouthpiece.

13. The drink container of claim 1, wherein the mouthpiece portion permits a user to draw drink liquid from the drink container by sucking upon the mouthpiece portion when the mouthpiece assembly is in the dispensing configuration but not when the mouthpiece assembly is in the stowed configuration.

14. The drink container of claim 1, wherein the anchor portion includes a plurality of flanges that are sized and shaped to provide a friction-fit arrangement with the through-passage, and further wherein the anchor portion is sized such that it will not pass through the through-passage.

15. The drink container of claim 1, wherein the mouthpiece assembly further includes a projecting tab that extends from the anchor portion and provides a region for being grasped by a user.

16. The drink container of claim 1, wherein the drink container includes a straw with a first end that extends into the liquid container and a second end that extends into the anchor portion and is retained therein by a friction-fit arrangement.

17. The drink container of claim 1, wherein the cap assembly further includes: an air return assembly configured to permit air from external the drink container to enter the internal compartment of the liquid container without having to pass through the liquid passage of the mouthpiece assembly, wherein the mouthpiece portion is positioned directly above the air return assembly when the mouthpiece assembly is in the stowed configuration and is not positioned directly above the air return assembly when the mouthpiece assembly is in the dispensing configuration.

18. The drink container of claim 17, wherein the air return assembly includes an air return valve in the form of a pressure-actuated valve that selectively permits air from external the drink container to enter the internal compartment of the liquid container.

19. The drink container of claim 1, wherein the mouthpiece assembly is configured to be selectively coupled to and decoupled from the base of the cap assembly via an underside of the base but not via a top side of the base.

20. A drink container, comprising:

a liquid container having a neck with an opening and having an internal compartment sized to hold a volume of potable drink liquid; and a cap assembly removably coupled to the liquid container, the cap assembly comprising:

a base removably coupled to the neck of the liquid container and including a through-passage extending through the base;

a first catch structure coupled to the base;

a mouthpiece assembly extending through the through-passage of the base and defining a liquid passage through which drink liquid from the liquid container may selectively flow, and further defining an inlet through which drink liquid in the internal compartment may enter the liquid passage and an outlet through which drink liquid from the internal compartment of the liquid container is selectively dispensed from the liquid passage;

wherein the mouthpiece assembly is configured to be selectively positioned between a dispensing configuration, in which the liquid passage permits drink liquid to flow from the internal compartment at least into the liquid passage, and a stowed configuration, in which the liquid passage restricts the flow of drink liquid through the liquid passage;

wherein the mouthpiece assembly is biased to the dispensing configuration;

wherein the mouthpiece assembly comprises a mouthpiece portion, an anchor portion, and a tube portion that extends between the mouthpiece portion and the anchor portion, wherein the mouthpiece portion, the tube portion, and the anchor portion are constructed as a unitary assembly;

wherein the mouthpiece portion includes the outlet;

wherein the tube portion defines at least a portion of the liquid passage for drink liquid to flow from the internal compartment to the mouthpiece portion;

wherein the tube portion includes a crimping region constructed of a resiliently deformable material;

wherein the crimping region is configured to restrict the flow of drink liquid through the liquid passage when the mouthpiece assembly is in the stowed configuration;

wherein the anchor portion is sized to restrict passage of the anchor portion through the through-passage of the base of the cap assembly; and further wherein the mouthpiece assembly includes a rigid collar member that is pivotally coupled to the base; wherein the tube portion of the mouthpiece assembly extends through the rigid collar member; and wherein the rigid collar member includes a second catch structure configured to be selectively engaged with the first catch structure to retain the mouthpiece assembly in the stowed configuration; and a user release mechanism configured to automatically disengage the first and second catch structures upon actuation of the user release mechanism and thereby release the mouthpiece assembly to move via its bias from the stowed configuration to the dispensing configuration; wherein the base includes a sidewall with an aperture, and further wherein the user release mechanism includes a user engagement pad in the form of a push button that extends through the aperture.

21. The drink container of claim 20, wherein the mouthpiece portion, the tube portion, and the anchor portion are constructed as a unitary assembly of the resiliently deformable material.

22. The drink container of claim 20, wherein the rigid collar member includes a stop surface that does not engage the base of the cap assembly when the mouthpiece assembly is in the stowed configuration and that engages the base of the cap assembly when the mouthpiece assembly is in the dispensing configuration to define a dispensing position of the mouthpiece portion.

23. The drink container of claim 20, wherein the crimping region at least partially biases the mouthpiece assembly to the dispensing configuration.

24. The drink container of claim 20, wherein the cap assembly further includes a handle that projects away from the base of the cap assembly and a pair of lateral guards that at least partially define a stowing region that receives at least a portion of the mouthpiece assembly between the pair of lateral guards when the mouthpiece assembly is in the stowed configuration.

25. The drink container of claim 24, wherein the handle further includes a dust cover portion that extends between the lateral guards and which extends across the outlet when the mouthpiece assembly is in the stowed configuration.

26. The drink container of claim 20, wherein the mouthpiece portion includes a bite-actuated mouthpiece.

27. The drink container of claim 20, wherein the mouthpiece portion permits a user to draw drink liquid from the drink container by sucking upon the mouthpiece portion when the mouthpiece assembly is in the dispensing configuration but not when the mouthpiece assembly is in the stowed configuration.

28. The drink container of claim 20, wherein the anchor portion includes a plurality of flanges that are sized and shaped to provide a friction-fit arrangement with the through-passage, and further wherein the anchor portion is sized such that it will not pass through the through-passage.

29. The drink container of claim 20, wherein the mouthpiece assembly further includes a projecting tab that extends from the anchor portion and provides a region for being grasped by a user.

30. The drink container of claim 20, wherein the drink container includes a straw with a first end that extends into the liquid container and a second end that extends into the anchor portion and is retained therein by a friction-fit arrangement.

31. The drink container of claim 20, wherein the cap assembly further includes: an air return assembly configured to permit air from external the drink container to enter the internal compartment of the liquid container without having to pass through the liquid passage of the mouthpiece assembly, wherein the mouthpiece portion is positioned directly above the air return assembly when the mouthpiece assembly is in the stowed configuration and is not positioned directly above the air return assembly when the mouthpiece assembly is in the dispensing configuration.

32. The drink container of claim 31, wherein the air return assembly includes an air return valve in the form of a pressure-actuated valve that selectively permits air from external the drink container to enter the internal compartment of the liquid container.

33. The drink container of claim 20, wherein the mouthpiece assembly is configured to be selectively coupled to and decoupled from the base of the cap assembly via an underside of the base but not via a top side of the base.

* * * * *

UNITED STATES PATENT AND TRADEMARK OFFICE

CERTIFICATE OF CORRECTION

PATENT NO. : 8,469,226 B2
APPLICATION NO. : 13/620078
DATED : June 25, 2013
INVENTOR(S) : Jeff Davies and Derek Gavin Sullivan It is certified that error appears in the above-identified patent and that said Letters Patent is hereby corrected as shown below:

In the Claims:

Column 21, line 36, after "wherein the mouthpiece portion" please delete "that".

Signed and Sealed this
Third Day of September, 2013

Teresa Stanek Rea
*Acting Director of the United States Patent and Trademark Office*